US010087392B2

(12) United States Patent
Moriizumi et al.

(10) Patent No.: US 10,087,392 B2
(45) Date of Patent: Oct. 2, 2018

(54) LUBRICANT COMPOSITION AND LUBRICANT OIL COMPOSITION CONTAINING SAME

(71) Applicant: ADEKA CORPORATION, Tokyo (JP)

(72) Inventors: Yukiya Moriizumi, Tokyo (JP); Kenji Yamamoto, Tokyo (JP)

(73) Assignee: ADEKA CORPORATION, Tokyo (JP)

( * ) Notice: Subject to any disclaimer, the term of this patent is extended or adjusted under 35 U.S.C. 154(b) by 0 days.

(21) Appl. No.: 15/038,225

(22) PCT Filed: Nov. 5, 2014

(86) PCT No.: PCT/JP2014/079329
§ 371 (c)(1),
(2) Date: May 20, 2016

(87) PCT Pub. No.: WO2015/076103
PCT Pub. Date: May 28, 2015

(65) Prior Publication Data

US 2016/0289589 A1 Oct. 6, 2016

(30) Foreign Application Priority Data

Nov. 22, 2013 (JP) ..... 2013-241848

(51) Int. Cl.
*C10M 161/00* (2006.01)
*C10M 135/18* (2006.01)
*C10M 145/14* (2006.01)

(52) U.S. Cl.
CPC .... *C10M 161/00* (2013.01); *C10M 2209/084* (2013.01); *C10M 2219/068* (2013.01); *C10N 2210/06* (2013.01); *C10N 2220/021* (2013.01); *C10N 2230/06* (2013.01); *C10N 2240/10* (2013.01)

(58) Field of Classification Search
CPC ..... C10M 161/00; C10M 2209/084; C10M 2219/068; C10N 2210/06; C10N 2220/021; C10N 2230/06; C10N 2240/10
USPC ..... 508/363
See application file for complete search history.

(56) References Cited

U.S. PATENT DOCUMENTS

| | | | | |
|---|---|---|---|---|
| 5,627,146 | A * | 5/1997 | Tanaka | C10M 135/18 508/363 |
| 2006/0189490 | A1* | 8/2006 | Dardin | C08F 293/005 508/469 |
| 2013/0274158 | A1 | 10/2013 | Woodward et al. | |

FOREIGN PATENT DOCUMENTS

| | | | | |
|---|---|---|---|---|
| CN | 103068956 | | 4/2013 | |
| CN | 103374440 | | 10/2013 | |
| EP | 0570093 | A1 * | 11/1993 | C08F 220/18 |
| EP | 2 607 464 | | 6/2013 | |
| WO | 2013/089143 | | 6/2013 | |

OTHER PUBLICATIONS

Extended European Search Report dated May 9, 2017 in corresponding European Application No. 14864922.1.

* cited by examiner

*Primary Examiner* — James C Goloboy
(74) *Attorney, Agent, or Firm* — Wenderoth, Lind & Ponack, L.L.P.

(57) ABSTRACT

The present invention relates to a lubricant composition including a molybdenum dithiocarbamate (A) represented by the general formula (1) and a copolymer (B) that includes, as essential constitutional units, a unit (a) represented by the general formula (2) and a unit (b) represented by the general formula (3), has a weight-average molecular weight of from 5,000 to 150,000, and has a composition ratio of the unit (a) to the unit (b), i.e., (a)/(b), of from 50/50 to 90/10 by mole, and a lubricant oil composition including same.

8 Claims, No Drawings

LUBRICANT COMPOSITION AND LUBRICANT OIL COMPOSITION CONTAINING SAME

TECHNICAL FIELD

The present invention relates to an additive for a lubricating oil that exhibits a satisfactory friction-reducing effect under a high contact pressure, and to a lubricating oil composition obtained by blending the additive in a base oil.

BACKGROUND ART

Lubricating oil is used in all instruments and machines including friction sites. This is because lubricating oil has important roles in suppressing friction, abrasion, seizure, and the like as much as possible to prolong the life of the instruments and machines. However, the various performances demanded of lubricating oil depend on the types of instruments and machines or the intended purposes, and in particular, reduction of friction under severe conditions in which high contact pressures are applied is considered to be very difficult in the lubrication field.

Lubricating oil performance is evaluated by various methods including test methods using an actual machine and test methods using a model machine for testing friction sites assumed from an actual machine. Although it is preferable to use an actual machine to finally measure accurate practical performance, tests using actual machines require an immense amount of time and cost and hence are impracticable for initial performance evaluation. Accordingly, as a first evaluation, evaluations using a model machine for testing a friction site assumed from an actual machine are employed in many cases. Model tests for investigating the degrees of friction, abrasion, seizure, and the like are classified into three types depending on contact types, i.e., point contact, line contact, and surface contact. Typical examples of tests based on the point contact include high-speed four-ball friction tests, ball-on-disc friction and wear tests, and ball-on-plate reciprocating wear tests, typical examples of tests based on the line contact include block-on-ring friction tests and two-roller tests, and typical examples of tests based on the surface contact include ring-on-disc friction and wear tests and block-on-plate friction and wear tests. Of those, the tests based on the point contact are considered as the most severe test because a contact pressure higher than the line contact and the surface contact is applied.

In general, out of existing friction-reducing agents, organic molybdenum compounds are well known to have high friction-reducing effects (Patent Literature 1 to 4). Organic molybdenum compounds are considered to form a molybdenum disulfide film on a sliding surface on which metals come in contact with each other, such as a boundary lubrication area, that is, apart to which some degree of temperature and load are applied, to exhibit a friction-reducing effect, and the effect has been found in all lubricating oils, such as engine oils. However, organic molybdenum compounds do not exhibit friction-reducing effects under all conditions. Under severe conditions in which a high contact pressure is applied, such as point contact, it may be difficult to reduce the friction because the effect is lowered. Accordingly, in the market, there is a strong desire for the development of an additive for a lubricating oil that exhibits a friction-reducing effect effectively under all conditions.

CITATION LIST

Patent Literature

[PTL 1] JP 09-151387 A

[PTL 2] JP 07-53983 A

[PTL 3] JP 2008-189561 A

[PTL 4] JP 10-17586 A

SUMMARY OF INVENTION

Technical Problem

Therefore, an object of the present invention is to provide: an additive composition for a lubricating oil that exhibits a high friction-reducing effect even under a severe condition in which a high contact pressure is applied; and a lubricating oil composition obtained by blending the composition in a base oil.

Solution to Problem

In view of the foregoing, the inventors of the present invention after keen study, found an additive for a lubricating oil, comprising both a molybdenum dithiocarbamate and an acrylic polymer, and exhibiting a high friction-reducing effect even under severe conditions in which a high contact pressure is applied. Thus, the inventors of the present invention reached the present invention. Specifically, according to one embodiment of the present invention, there is provided a lubricant composition, including: a molybdenum dithiocarbamate (A) represented by the following general formula (1); and a copolymer (B) that includes, as essential constitutional units, a unit (a) represented by the following general formula (2) and a unit (b) represented by the following general formula (3), has a weight-average molecular weight of from 5,000 to 150,000, and has a composition ratio of the unit (a) to the unit (b), i.e., (a)/(b), of from 50/50 to 90/10 by mole:

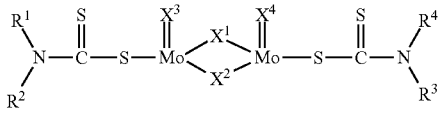

(1)

where $R^1$ to $R^4$ each independently represent a hydrocarbon group having 1 to 20 carbon atoms, and $X^1$ to $X^4$ each independently represent a sulfur atom or an oxygen atom;

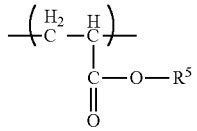

(2)

where $R^5$ represents an alkyl group having 4 to 18 carbon atoms; and (3)

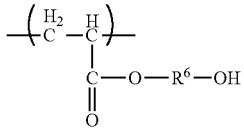

where $R^6$ represents an alkylene group having 2 to 4 carbon atoms.

Advantageous Effects of Invention

The additive composition for a lubricating oil according to the one embodiment of the present invention and a lubricating oil composition prepared by blending the composition in a base oil exhibit a high friction-reducing effect even under severe conditions in which a high contact pressure is applied. Specifically, when the copolymer (B) to be used in the present invention is used in combination with the molybdenum dithiocarbamate (A) to be used in the present invention, the friction-reducing effect of the molybdenum dithiocarbamate (A) in the lubricating oil is further enhanced.

DESCRIPTION OF EMBODIMENTS

A lubricant composition of the present invention includes: a molybdenum dithiocarbamate (A) represented by the following general formula (1); and a copolymer (B) that includes, as essential constitutional units, a unit (a) represented by the following general formula (2) and a unit (b) represented by the following general formula (3), has a weight-average molecular weight of from 5,000 to 150,000, and has a composition ratio of the unit (a) to the unit (b), i.e., (a)/(b), of from 50/50 to 90/10 by mole.

(1)

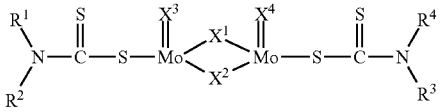

(In the formula, $R^1$ to $R^4$ each independently represent a hydrocarbon group having 1 to 20 carbon atoms, and $X^1$ to $X^4$ each independently represent a sulfur atom or an oxygen atom.)

(2)

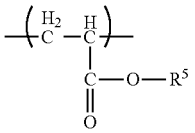

(In the formula, $R^5$ represents an alkyl group having 4 to 18 carbon atoms.)

(3)

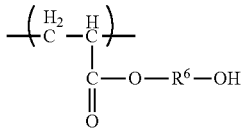

(In the formula, $R^6$ represents an alkylene group having 2 to 4 carbon atoms.)

An organic molybdenum compound to be used in the present invention is the molybdenum dithiocarbamate (A) represented by the following general formula (1).

(1)

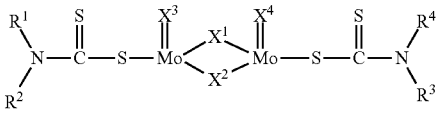

(In the formula, $R^1$ to $R^4$ each independently represent a hydrocarbon group having 1 to 20 carbon atoms, and $X^1$ to $X^4$ each independently represent a sulfur atom or an oxygen atom.)

In the general formula (1), $R^1$ to $R^4$ each independently represent a hydrocarbon group having 1 to 20 carbon atoms. Examples of such group include: saturated aliphatic hydrocarbon groups, such as a methyl group, an ethyl group, an n-propyl group, an isopropyl group, an n-butyl group, an isobutyl group, an s-butyl group, a t-butyl group, an n-pentyl group, a branched pentyl group, a sec-pentyl group, a tert-pentyl group, an n-hexyl group, a branched hexyl group, a sec-hexyl group, a tert-hexyl group, an n-heptyl group, a branched heptyl group, a sec-heptyl group, a tert-heptyl group, an n-octyl group, a 2-ethylhexyl group, a branched octyl group, a sec-octyl group, a tert-octyl group, an n-nonyl group, a branched nonyl group, a sec-nonyl group, a tert-nonyl group, an n-decyl group, a branched decyl group, a sec-decyl group, a tert-decyl group, an n-undecyl group, a branched undecyl group, a sec-undecyl group, a tert-undecyl group, an n-dodecyl group, a branched dodecyl group, a sec-dodecyl group, a tert-dodecyl group, an n-tridecyl group, a branched tridecyl group, a sec-tridecyl group, a tert-tridecyl group, an n-tetradecyl group, a branched tetradecyl group, a sec-tetradecyl group, a tert-tetradecyl group, an n-pentadecyl group, a branched pentadecyl group, a sec-pentadecyl group, a tert-pentadecyl group, a n-hexadecyl group, a branched hexadecyl group, a sec-hexadecyl group, a tert-hexadecyl group, an n-heptadecyl group, a branched heptadecyl group, a sec-heptadecyl group, a tert-heptadecyl group, an n-octadecyl group, a branched octadecyl group, a sec-octadecyl group, a tert-octadecyl group, an n-nonadecyl group, a branched nonadecyl group, a sec-nonadecyl group, a tert-nonadecyl group, an n-icosyl group, a branched icosyl group, a sec-icosyl group, and a tert-icosyl group; unsaturated aliphatic hydrocarbon groups, such as a vinyl group, a 1-propenyl group, an allyl group, a 1-butenyl group, a 2-butenyl group, a 3-butenyl group, a 1-methyl-2-propenyl group, a 2-methyl-2-propenyl group, a 1-pentenyl group, a 2-pentenyl group, 3-pentenyl group, a 4-pentenyl group, a 1-methyl-2-butenyl group, a 2-methyl-2-butenyl group, a 1-hexenyl group, a 2-hexenyl group, a 3-hexenyl group, a 4-hexenyl group, a 5-hexenyl group, a 1-heptenyl group, a 6-heptenyl group, a 1-octenyl group, a 7-octenyl group, an 8-nonenyl group, a 1-decenyl group, a 9-decenyl group, a 10-undecenyl group, a 1-dodecenyl group, a 4-dodecenyl group, a 11-dodecenyl group, a 12-tridecenyl group, a 13-tetradecenyl group, a 14-pentadecenyl group, a 15-hexadecenyl group, a 16-heptadecenyl group, a 1-octadecenyl group, a 2-ethyl-1-octadecenyl group, a 17-octadecenyl group, an 18-nonadecenyl group, and a 19-icocenyl group; aromatic hydrocarbon groups, such as a phenyl group, a toluyl group, a xylyl group, a cumenyl group, a mesityl group, a benzyl group, a phenethyl group, a styryl group, a cinnamyl group, a benzhydryl group, a trityl group, an ethylphenyl group, a propylphenyl group, a butylphenyl group, a pentylphenyl group, a hexylphenyl group, a heptylphenyl group, an octylphenyl group, a nonylphenyl group, a decylphenyl group, an undecylphenyl group, a dodecylphenyl group, a styrenated phenyl group, a p-cumylphenyl group, a phenylphenyl group, a benzylphenyl group, an α-naphthyl group, and a β-naphthyl group; and alicyclic hydrocarbon groups, such as a cyclopropyl group, a cyclobutyl group, a cyclopentyl group, a cyclohexyl group, a cycloheptyl group, a cyclooctyl group, a methylcyclopentyl group, a methylcyclohexyl group, a methylcycloheptyl group, a methylcyclooctyl group, a 4,4,6,6-tetramethylcyclohexyl group, a 1,3-dibutylcyclohexyl group, a norbornyl group, a bicyclo[2.2.2]octyl group, an adamantyl group, a 1-cyclobutenyl group, a 1-cyclopentenyl group, a 3-cyclopentenyl group, a 1-cyclohexenyl group, a 3-cyclohexenyl group, a 3-cycloheptenyl group, a 4-cyclooctenyl group, a 2-methyl-3-cyclohexenyl group, and a 3,4-dimethyl-3-cyclohexenyl group. Of those, a saturated aliphatic hydrocarbon group and an unsaturated aliphatic hydrocarbon group are preferred, and a saturated aliphatic hydrocarbon group is more preferred, because the effect of the present invention can easily be obtained. In addition, a saturated aliphatic hydrocarbon group having 3 to 15 carbon atoms is still more preferred, and a saturated aliphatic hydrocarbon group having 8 to 13 carbon atoms is most preferred, because the effects of the present invention can easily be obtained and production can easily be carried out. It should be noted that $R^1$ to $R^4$ in the general formula (1) may be the same as or different from each other, and preferably represent two or more kinds of groups because the effects of the present invention can easily be obtained by a synergistic effect with the copolymer (B).

In the general formula (1), $X^4$ to $X^4$ each independently represent a sulfur atom or an oxygen atom. Of those, it is preferred that $X^4$ and $X^2$ each represent a sulfur atom, and it is more preferred that $X^4$ and $X^2$ each represent a sulfur atom and $X^3$ and $X^4$ each represent an oxygen atom, because the effects of the present invention can be easily obtained.

In addition, a production method for the molybdenum dithiocarbamate (A) represented by the general formula (1) to be used in the present invention may be a known production method, and examples of the method include production methods described in JP 62-81396 A, JP 07-53983 A, JP 08-217782 A, and JP 10-17586 A, which are Japanese patent publications. Technical contents in those publications are appropriately incorporated by reference herein.

The copolymer (B) to be used in the present invention is a copolymer including, as essential constitutional units, a unit (a) represented by the following general formula (2) and a unit (b) represented by the following general formula (3).

(2)

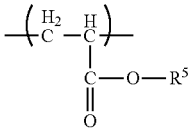

(In the formula, $R^5$ represents an alkyl group having 4 to 18 carbon atoms.)

(3)

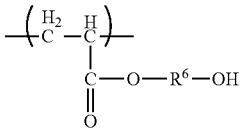

(In the formula, $R^6$ represents an alkylene group having 2 to 4 carbon atoms.)

$R^5$ in the general formula (2) represents an alkyl group having 4 to 18 carbon atoms, and examples thereof include: linear primary alkyl groups, such as an n-butyl group, an n-pentyl group, an n-hexyl group, an n-heptyl group, an n-octyl group, an n-nonyl group, an n-decyl group, an n-undecyl group, an n-dodecyl group, an n-tridecyl group, an n-tetradecyl group, an n-pentadecyl group, an n-hexadecyl group, an n-heptadecyl group, and an n-octadecyl group; branched primary alkyl groups, such as an isobutyl group, a branched primary pentyl group, a branched primary hexyl group, a branched primary heptyl group, a branched primary octyl group (for example, a 2-ethylhexyl group), a branched primary nonyl group, a branched primary decyl group, a branched primary undecyl group, a branched primary dodecyl group, a branched primary tridecyl group, a branched primary tetradecyl group, a branched primary pentadecyl group, a branched primary hexadecyl group, a branched primary heptadecyl group, and a branched primary octadecyl group; sec-alkyl groups, such as a s-butyl group, a sec-pentyl group, a sec-hexyl group, a sec-heptyl group, a sec-octyl group, a sec-nonyl group, a sec-decyl group, a sec-undecyl group, a sec-dodecyl group, a sec-tridecyl group, a sec-tetradecyl group, a sec-pentadecyl group, a sec-hexadecyl group, a sec-heptadecyl group, and a sec-octadecyl group; and tert-alkyl groups, such as a t-butyl group, a tert-pentyl group, a tert-hexyl group, a tert-heptyl group, a tert-octyl group, a tert-nonyl group, a tert-decyl group, a tert-undecyl group, a tert-dodecyl group, a tert-tridecyl group, a tert-tetradecyl group, a tert-pentadecyl group, a tert-hexadecyl group, a tert-heptadecyl group, and a tert-octadecyl group. Of those, from the viewpoint that a copolymer which effectively exhibits the effects of the present invention can be obtained, a primary alkyl group (in this case, the alkyl group may be a linear or branched form) is preferred, and from the viewpoints that a copolymer which effectively exhibits the effects of the present invention can be obtained, and that a copolymer which further has satisfactory solubility in a base oil can be obtained, a primary alkyl group having 10 to 18 carbon atoms (in this case, the alkyl group may be a linear or branched form) is more preferred, a primary alkyl group having 12 to 18 carbon atoms (in this case, the alkyl group may be a linear or branched form) is still more preferred, and a linear primary alkyl group having 12 to 18 carbon atoms is most preferred.

$R^6$ of the general formula (3) represents an alkylene group having 2 to 4 carbon atoms and examples thereof include an ethylene group, a propane-1,3-diyl group, a propane-1,2-diyl group, apropane-2,2-diyl group, a butane-1,4-diyl group, a butane-1,2-diyl group, a butane-1,3-diyl group, a butane-2,3-diyl group, a butane-1,1-diyl group, a butane-2,2-diyl group, a 2-methylpropane-1,3-diyl group, and a 2-methylpropane-1,2-diyl group. Of those, $R^6$ represents preferably an alkylene group having 2 to 3 carbon atoms, more preferably an ethylene group, because a copolymer that effectively exhibits the effects of the present invention can be obtained.

The copolymer (B) may include one or two or more kinds of units (a) in which $R^5$'s in the general formula (2) are different from each other and may include one or two or more kinds of units (b) in which $R^6$'s in the general formula (3) are different from each other as long as the copolymer includes, as essential constitutional units, the unit (a) represented by the general formula (2) and the unit (b) represented by the general formula (3).

The copolymer (B) including the unit (a) and the unit (b) as essential constitutional units is preferably a copolymer (B) including a total of 90 mass % or more of the unit (a) and the unit (b), more preferably a copolymer (B) including a total of 95 mass % or more of the unit (a) and the unit (b), because the effects of the present invention can be easily obtained. In addition, it is still more preferred that the copolymer (B) consist essentially of the unit (a) and the unit (b). The expression "consist essentially of" as used herein refers to the fact that the copolymer (B) mainly includes the unit (a) and the unit (b) and includes 1 mass % or less of a unit other than the unit (a) or the unit (b). It is most preferred that the copolymer (B) consist of the unit (a) and the unit (b). The mode of polymerization of the copolymer (B) is not particularly specified, and a raw material monomer for forming the unit (a) and a raw material monomer for forming the unit (b) may be subjected to block copolymerization, random copolymerization, alternating copolymerization, or graft copolymerization. The composition ratio of the unit (a) and the unit (b) greatly affects the extreme-pressure performance and solubility in a base oil of the copolymer (B) to be obtained, and hence the composition ratio of the unit (a) to the unit (b), i.e., (a)/(b), is required to be from 50/50 to 90/10 by mole. In particular, the composition ratio, i.e., (a)/(b), is preferably from 55/45 to 85/15, more preferably from 60/40 to 80/20, most preferably from 60/40 to 70/30, because the copolymer (B) exhibits more excellent extreme-pressure performance and high solubility in a base oil. When the ratio of the unit (a) is higher than (a)/(b)=90/10, an effect of combination use of the molybdenum dithiocarbamate (A) and the copolymer (B) may not be obtained, resulting in failing to achieve the effects of the present invention, while when the ratio of the unit (b) is higher than (a)/(b)=50/50, the solubility in a base oil may deteriorate, resulting in arising problems such as precipitation and turbidity.

The copolymer (B) including the unit (a) and the unit (b) as essential constitutional units is required to have a weight-average molecular weight of from 5,000 to 150,000. In particular, the weight-average molecular weight is preferably from 10,000 to 130,000, more preferably from 40,000 to 130,000, still more preferably from 40,000 to 110,000, even more preferably from 50,000 to 110,000, most preferably from 50,000 to 75,000, because the composition exhibits more excellent extreme-pressure performance and high solubility in a base oil, and in consideration of easy production and handling. When the weight-average molecular weight is less than 5,000, the composition may not exhibit the effects of the present invention, while when the weight-average molecular weight is more than 150,000, the composition may not be dissolved in a base oil. It should be noted that the weight-average molecular weight is measured by GPC and calculated in terms of styrene.

A method of producing the copolymer (B) to be used in the present invention is not particularly limited, and the copolymer (B) may be produced by any of known methods. However, an alkyl acrylate having an alkyl group having 4 to 18 carbon atoms is preferably used as a raw material for forming the unit (a), and a hydroxyalkyl acrylate having an alkylene group having 2 to 4 carbon atoms is preferably used as a raw material for forming the unit (b). That is, examples of the method of producing the copolymer (B) using those raw materials include mass polymerization, emulsion polymerization, suspension polymerization, and solution polymerization. The lubricant composition of the present invention is used by being added to a base oil, such as a mineral oil or a synthetic oil. Accordingly, the mass polymerization or solution polymerization is preferred as compared to a polymerization method using water as a solvent, such as the emulsion polymerization or suspension polymerization, and the solution polymerization is more preferred because the reaction proceeds smoothly.

Examples of the raw material for forming the unit (a) include n-butyl acrylate, isobutyl acrylate, s-butyl acrylate, t-butyl acrylate, n-pentyl acrylate, isopentyl acrylate, n-hexyl acrylate, n-heptyl acrylate, n-octyl acrylate, 2-ethylhexyl acrylate, n-nonyl acrylate, isononyl acrylate, n-decyl acrylate, n-undecyl acrylate, n-dodecyl acrylate, n-tridecyl acrylate, n-tetradecyl acrylate, n-pentadecyl acrylate, n-hexadecyl acrylate, n-heptadecyl acrylate, and n-octadecyl acrylate. Of those, for the reason that a copolymer which effectively exhibits the effects of the present invention can be obtained, n-butyl acrylate, isobutyl acrylate, n-pentyl acrylate, isopentyl acrylate, n-hexyl acrylate, n-heptyl acrylate, n-octyl acrylate, 2-ethylhexyl acrylate, n-nonyl acrylate, isononyl acrylate, n-decyl acrylate, n-undecyl acrylate, n-dodecyl acrylate, n-tridecyl acrylate, n-tetradecyl acrylate, n-pentadecyl acrylate, n-hexadecyl acrylate, n-heptadecyl acrylate, or n-octadecyl acrylate is preferred, n-decyl acrylate, n-undecyl acrylate, n-dodecyl acrylate, n-tridecyl acrylate, n-tetradecyl acrylate, n-pentadecyl acrylate, n-hexadecyl acrylate, n-heptadecyl acrylate, or n-octadecyl acrylate is more preferred, and n-dodecyl acrylate, n-tridecyl acrylate, n-tetradecyl acrylate, n-hexadecyl acrylate, or n-octadecyl acrylate is still more preferred.

Examples of the raw material for forming the unit (b) include 2-hydroxyethyl acrylate, 2-hydroxypropyl acrylate, 3-hydroxypropyl acrylate, 2-hydroxybutyl acrylate, and 4-hydroxybutyl acrylate. Of those, for the reason that a copolymer which effectively exhibits the effects of the present invention can be obtained, 2-hydroxyethylacrylate, 2-hydroxypropyl acrylate, or 3-hydroxypropyl acrylate is preferred, and 2-hydroxyethyl acrylate is more preferred.

A specific method for the solution polymerization may be as described below. For example, the raw material monomer for forming the unit (a) and the raw material monomer for forming the unit (b) are loaded into a reactor with a solvent at a total monomer content of from 5 mass % to 80 mass %, and then a temperature is increased to from about 50° C. to about 120° C. An initiator is added in an amount of from 0.1 mol % to 10 mol % with respect to the total amount of the monomers at one time or in fractional amounts, and the mixture is subjected to a reaction for from about 1 hour to about 20 hours while the mixture is stirred so that a product has a weight-average molecular weight of from 5,000 to 150,000. Alternatively, the method may be as described below. The monomers and a catalyst are loaded at one time, and temperature is increased to from 50° C. to 120° C. The resultant is subjected to a reaction for from about 1 hour to about 20 hours while the mixture is stirred so that a product has a weight-average molecular weight of from 5,000 to 150,000.

Examples of the solvent that may be used include: alcohols, such as methanol, ethanol, propanol, and butanol;

hydrocarbons, such as benzene, toluene, xylene, and hexane; esters, such as ethyl acetate, butyl acetate, and isobutyl acetate; ketones, such as acetone, methyl ethyl ketone, and methyl isobutyl ketone; ethers, such as methoxybutanol, ethoxybutanol, ethylene glycol monomethyl ether, ethylene glycol dimethyl ether, ethylene glycol monobutyl ether, propylene glycol monomethyl ether, propylene glycol dimethyl ether, propylene glycol monobutyl ether, and dioxane; mineral oils, such as a paraffin-based mineral oil, a naphthene-based mineral oil, and refined mineral oils obtained by refining these mineral oils through hydrotreating, solvent deasphalting, solvent extraction, solvent dewaxing, hydrogenation dewaxing, catalytic dewaxing, hydrocracking, alkaline distillation, sulfuric acid washing, clay treatment, or the like; and synthetic oils, such as a poly-α-olefin, an ethylene-α-olefin copolymer, polybutene, an alkylbenzene, an alkylnaphthalene, polyphenyl ether, an alkyl-substituted diphenyl ether, a polyol ester, a dibasic acid ester, a hindered ester, a monoester, and gas to liquids (GTL), and mixtures thereof.

Examples of the initiator that may be used include: azo-based initiators, such as 2,2'-azobis(2-methylpropionitrile), 2,2'-azobis(2-amidinopropane) dihydrochloride, 2,2'-azobis-(N,N-dimethyleneisobutylamidine) dihydrochloride, and 1,1'-azobis(cyclohexyl-1-carbonitrile); hydrogen peroxide and organic peroxides, such as benzoyl peroxide, t-butyl hydroperoxide, cumene hydroperoxide, methyl ethyl ketone peroxide, and perbenzoic acid; persulfuric acid salts, such as sodium persulfate, potassium persulfate, and ammonium persulfate; redox initiators, such as hydrogen peroxide-$Fe^{3+}$; and other existing radical initiators.

When the copolymer (B) to be used in the lubricant composition of the present invention has a weight-average molecular weight of from 5,000 to 150,000, the composition exhibits the effects of the present invention. Through the control of, for example, the reaction temperature, the time for polymerization, and the amount of the initiator, the molecular weight of the polymer can be adjusted to produce a polymer having a desired molecular weight. A polymer having a large molecular weight can be produced relatively easily by adjusting, for example, the reaction temperature, the time for polymerization, and the amount of the initiator, while a polymer having a small molecular weight can be produced by a method selected from, for example, a polymerization method involving using a solvent having a high chain transfer constant, a polymerization method involving adding a chain transfer agent, and a method involving using a solvent having a high chain transfer constant and a chain transfer agent in combination. When the methods are employed properly, polymers having large molecular weights as well as polymers having small molecular weights can be produced.

Examples of the solvent having a high chain transfer constant include ethanol, propanol, isopropanol, butanol, isobutanol, toluene, ethylbenzene, isopropylbenzene, methyl ethyl ketone, chloroform, and carbon tetrachloride.

Examples of the chain transfer agent include: thiol-based compounds, such as mercaptoethanol, thioglycerol, thioglycolic acid, 3-mercaptopropionic acid, thiomalic acid, 2-mercaptoethanesulfonic acid, butanethiol, octanethiol, decanethiol, dodecanethiol, hexadecanethiol, octadecanethiol, cyclohexylmercaptan, thiophenol, octyl thioglycolate, and octyl 3-mercaptopropionate; and secondary alcohols, such as isopropyl alcohol.

There are descriptions of a more detailed method of producing the copolymer (B) in Japanese patent publications, JP 2012-41407 A and JP 2013-124266 A, for example. According to the methods described in the publications, the copolymer (B) to be used in the present invention can be produced. These technical contents are appropriately incorporated by reference herein.

In addition, the copolymer (B) may be obtained by copolymerizing other monomers in addition to the raw material monomers for forming the units (a) and (b) as long as the effects of the present invention are not inhibited. A method of polymerizing other monomers is not particularly specified, and the copolymer may be obtained by: polymerizing the raw material monomers for forming the units (a) and (b) and then copolymerizing other monomers; or copolymerizing other monomers together with the raw material monomers for forming the units (a) and (b). Any monomers may be used as the other monomers as long as the other monomers have a double bond, and examples thereof include: aromatic vinyl monomers, such as styrene, vinyl toluene, 2,4-dimethylstyrene, 4-ethylstyrene, and 2-vinylnaphthalene; aliphatic vinyl monomers, such as vinyl acetate, vinyl propionate, vinyl octanoate, methyl vinyl ether, ethyl vinyl ether, and 2-ethylhexyl vinyl ether; halogen-based vinyl monomers, such as vinyl chloride, vinyl bromide, vinylidene chloride, allyl chloride, and dichlorostyrene; alkyl acrylates other than the raw material for forming the unit (a), such as methyl acrylate, ethyl acrylate, and propyl acrylate; and amino group-containing monomers, such as allylamine, aminoethyl acrylate, aminopropyl acrylate, aminobutyl acrylate, methylaminoethyl acrylate, 2-diphenylamine acrylamide, dimethylaminomethyl acrylate, dimethylaminomethyl acrylamide, N,N-dimethylaminostyrene, 4-vinylstyrene, and N-vinylpyrrolidone. It should be noted that the content of the other monomers in the copolymer to be obtained is preferably 10 mass % or less, more preferably 5 mass % or less, still more preferably 1 mass % or less. When the content of the other monomers in the copolymer (B) is more than 10 mass %, the effects of the present invention may be inhibited.

A methacrylic group is known to have a structure similar to that of an acrylic group. When a monomer having the methacrylic group is used to produce a copolymer, the copolymer may have lowered solubility in a base oil. The unit (a) and the unit (b) each have the acrylic group, and when the methacrylic group is present in place of the acrylic group, the effects of the present invention cannot be obtained. For example, when a copolymer produced using an alkyl methacrylate or a hydroxy alkylene methacrylate is used in combination with the molybdenum dithiocarbamate (A), the friction-reducing effect cannot be obtained.

The molybdenum dithiocarbamate (A) and copolymer (B) to be used in the present invention have been described above in detail. The lubricant composition of the present invention is a lubricant composition including both of them, and exhibits the effects of the present invention only when the composition includes both of them. As for the use ratio of the molybdenum dithiocarbamate (A) to the copolymer (B), the molybdenum content of the molybdenum dithiocarbamate (A) is preferably from 0.005 part by mass to 0.5 part by mass with respect to 1 part by mass of the copolymer (B). In particular, the molybdenum content of the molybdenum dithiocarbamate (A) is more preferably from 0.008 part by mass to 0.3 part by mass, still more preferably from 0.01 part by mass to 0.2 part by mass, most preferably from 0.03 part by mass to 0.15 part by mass with respect to 1 part by mass of the copolymer (B), because the effect of combination use of the molybdenum dithiocarbamate (A) and the copolymer (B) can be obtained more significantly. When the molybdenum content of the molybdenum dithiocarbamate (A) is less than 0.005 part by mass, a friction-reducing effect may not be obtained, while when the molybdenum content of the molybdenum dithiocarbamate (A) is more than 0.5 part by mass, a friction-reducing effect commensurate with the addition amount may not be obtained.

In addition to the molybdenum dithiocarbamate (A) and the copolymer (B), a diluent oil may be added to the lubricant composition of the present invention to dilute active components. The dilution rate is not particularly limited and may be appropriately determined depending on its intended use and use conditions. In particular, the concentration of the diluent oil is preferably from 10 mass % to 90 mass % with respect to the total amount of the molybdenum dithiocarbamate (A), the copolymer (B), and the diluent oil, because the composition is easy to handle. When the concentration of the diluent oil is less than 10 mass %, the lubricant composition may have a high viscosity and may be difficult to handle, while when the concentration of the diluent oil is more than 90 mass %, the amount of the lubricant composition used as an additive may increase because the composition includes only a small amount of active components.

Here, the diluent oil that can be used is not particularly limited, and is appropriately selected from, for example, a mineral base oil, a chemical synthetic base oil, animal and vegetable base oils, and a mixed base oil thereof depending on its intended use and use conditions. Here, examples of the mineral base oil include distillates each obtained by distilling, under normal pressure, a paraffin base crude oil, a naphthene base crude oil, or an intermediate base crude oil, or distilling, under reduced pressure, the residual oil of the distillation under normal pressure, and refined oils obtained by refining these distillates in accordance with an ordinary method, specifically a solvent-refined oil, a hydrogenated refined oil, a dewaxed oil, and a clay-treated oil. Examples of the chemical synthetic base oil include a poly-α-olefin, polyisobutylene (polybutene), a monoester, a diester, a polyol ester, a silicic acid ester, a polyalkylene glycol, polyphenyl ether, a silicone, a fluorinated compound, an alkylbenzene, and a GTL base oil. Of those, a poly-α-olefin, polyisobutylene (polybutene), a diester, a polyol ester, and the like can be universally used. Examples of the poly-α-olefin include polymerized forms or oligomerized forms of 1-hexene, 1-octene, 1-nonene, 1-decene, 1-dodecene, and 1-tetradecene, or hydrogenated forms thereof. Examples of the diester include diesters of dibasic acids, such as glutaric acid, adipic acid, azelaic acid, sebacic acid, and dodecanedioic acid, and alcohols, such as 2-ethylhexanol, octanol, decanol, dodecanol, and tridecanol. Examples of the polyol ester include esters of polyols, such as neopentyl glycol, trimethylolethane, trimethylolpropane, pentaerythritol, dipentaerythritol, and tripentaerythritol, and fatty acids, such as caproic acid, caprylic acid, lauric acid, capric acid, myristic acid, palmitic acid, stearic acid, and oleic acid. Examples of the animal and vegetable base oils include: vegetable oils and fats, such as castor oil, olive oil, cacao butter, sesame oil, rice bran oil, safflower oil, soybean oil, camellia oil, corn oil, rapeseed oil, palm oil, palm kernel oil, sunflower oil, cotton seed oil, and coconut oil; and animal oils and fats, such as beef tallow, lard, milk fat, fish oil, and whale oil. Of those, the diluent oil is preferably a mineral base oil or a chemical synthetic base oil, more preferably a mineral base oil, because the oil hardly inhibit the effects of the present invention. One kind of those various diluent oils described above may be used alone, or two or more kinds thereof may be appropriately used in combination.

A lubricating oil composition of the present invention is prepared by adding the lubricant composition of the present invention to a base oil. The addition amount of the lubricant composition of the present invention to the base oil is not particularly limited, and in order to exhibit a more satisfactory friction-reducing effect, the content of the molybdenum dithiocarbamate (A) in terms of molybdenum content is preferably from 50 ppm by mass to 5,000 ppm by mass, more preferably from 80 ppm by mass to 3,000 ppm by mass, still more preferably from 100 ppm by mass to 2,000 ppm by mass, most preferably from 300 ppm by mass to 1,500 ppm by mass, with respect to the lubricating oil composition including the base oil and additives. When the content is less than 50 ppm by mass, a friction-reducing effect may not be obtained, while when the content is more than 5,000 ppm by mass, a friction-reducing effect commensurate with the addition amount may not be obtained. The content of the copolymer (B) in the lubricating oil composition is calculated based on the use ratio of the molybdenum dithiocarbamate (A) and the copolymer (B) in the lubricant composition of the present invention described above and the preferred content of the organic molybdenum compound in the lubricating oil composition, and the copolymer (B) is preferably added in an amount consistent with the content. When the content of the copolymer (B) is too small, an effect of combination use of the molybdenum dithiocarbamate (A) and the copolymer (B) may not be obtained, while when the content is too high, an effect commensurate with the addition amount may not be obtained.

In addition, the base oil that can be used in the lubricating oil composition is not particularly limited, and is appropriately selected from, for example, a mineral base oil, a chemical synthetic base oil, animal and vegetable base oils, and a mixed base oil thereof depending on its intended use and use conditions. Here, examples of the mineral base oil include distillates each obtained by distilling, under normal pressure, a paraffin base crude oil, a naphthene base crude oil, or an intermediate base crude oil, or distilling, under reduced pressure, the residual oil of the distillation under normal pressure, and refined oils obtained by refining these distillates in accordance with an ordinary method, specifically a solvent-refined oil, a hydrogenated refined oil, a dewaxed oil, and a clay-treated oil. Examples of the chemical synthetic base oil include a poly-α-olefin, polyisobutylene (polybutene), a monoester, a diester, a polyol ester, a silicic acid ester, a polyalkylene glycol, polyphenyl ether, a silicone, a fluorinated compound, an alkylbenzene, and a GTL base oil. Of those, a poly-α-olefin, polyisobutylene (polybutene), a diester, a polyol ester, and the like can be universally used. Examples of the poly-α-olefin include polymerized forms or oligomerized forms of 1-hexene, 1-octene, 1-nonene, 1-decene, 1-dodecene, and 1-tetradecene, or hydrogenated forms thereof. Examples of the diester include diesters of dibasic acids, such as glutaric acid, adipic acid, azelaic acid, sebacic acid, and dodecanedioic acid, and alcohols, such as 2-ethylhexanol, octanol, decanol, dodecanol, and tridecanol. Examples of the polyol ester include esters of polyols, such as neopentyl glycol, trimethylolethane, trimethylolpropane, pentaerythritol, dipentaerythritol, and tripentaerythritol, and fatty acids, such as caproic acid, caprylic acid, lauric acid, capric acid, myristic acid, palmitic acid, stearic acid, and oleic acid. Examples of the animal and vegetable base oils include: vegetable oils and fats, such as castor oil, olive oil, cacao butter, sesame oil, rice bran oil, safflower oil, soybean oil, camellia oil, corn oil, rapeseed oil, palm oil, palm kernel oil, sunflower oil, cotton seed oil, and coconut oil; and animal oils and fats, such as beef tallow, lard, milk fat, fish oil, and whale oil. Of those, the base oil is preferably a mineral base oil or a chemical synthetic base oil, more preferably a mineral base oil, because the effects of the present invention can be obtained easily. One kind of these various base oils described above may be used alone, or two or more kinds thereof may be appropriately used in combination.

The lubricating oil composition of the present invention is prepared by adding the lubricant composition of the present invention to the base oil, and the effects of the present invention can be obtained by using the molybdenum dithiocarbamate (A) and the copolymer (B) in combination. Accordingly, a lubricant composition including the molybdenum dithiocarbamate (A) and the copolymer (B) may be added simultaneously to the base oil, or an additive including the molybdenum dithiocarbamate (A) and an additive including the copolymer (B) may be separately added to the base oil. In this procedure, the effects of the present invention can be obtained effectively as long as the use ratio of the molybdenum dithiocarbamate (A) and the copolymer (B), the molybdenum content with respect to the lubricating oil composition including the base oil and additives, and the content of the copolymer (B) with respect to the lubricating oil composition including the base oil and additives described above fall within preferred ranges.

The lubricating oil composition of the present invention can appropriately contain known lubricating oil additives depending on its intended use as long as the effects of the present invention are not impaired, and examples thereof include metal-based cleaning agents, ashless dispersants, abrasion-preventing agents, antioxidants, viscosity index improvers, pour-point depressants, rust inhibitors, corrosion inhibitors, metal deactivators, and antifoaming agents. One kind of these additives may be used and two or more kinds of the compounds may be used, and the total content of the additive(s) used is preferably from 0.01 mass % to 40 mass % with respect to the lubricating oil composition.

Examples of the metal-based cleaning agents include sulfonates, phenates, salicylates, and phosphates of calcium, magnesium, and barium, and overbased salts thereof. Of those, overbased salts are preferred, and out of the overbased salts, overbased salts having a total basic number (TBN) of from 10 mgKOH/g to 500 mgKOH/g are more preferred. The blending amount of such metal-based cleaning agent is preferably from 0.5 mass % to 10 mass %, more preferably from 1 mass % to 8 mass % with respect to the base oil.

Any ashless dispersant to be used in a lubricating oil can be used as the ashless dispersants without any particular limitation. The ashless dispersants are, for example, nitrogen-containing compounds having at least one linear or branched alkyl group or alkenyl group having 40 to 400 carbon atoms in a molecule thereof, or derivatives thereof. Specific examples of the nitrogen-containing compound include succinimide, succinamide, succinic acid esters, succinic acid ester-amides, benzylamine, polyamines, polysuccinimides, and Mannich bases, and specific examples of the derivatives thereof include products each obtained by subjecting any one of these nitrogen-containing compounds to a reaction with a boron compound, such as boric acid or a boric acid salt, a phosphorus compound, such as thiophosphoric acid or a thiophosphoric acid salt, an organic acid, and a hydroxypolyoxyalkylene carbonate. When the number of carbon atoms of the alkyl group or the alkenyl group is less than 40, the solubility of the compound in a lubricant base oil may be reduced. On the other hand, when the number of carbon atoms of the alkyl group or the alkenyl group is more than 400, the low-temperature fluidity of the lubricating oil composition may deteriorate. The blending amount of such ashless dispersant is preferably from 0.5 mass % to 10 mass %, more preferably from 1 mass % to 8 mass % with respect to the base oil.

Examples of the abrasion-preventing agents include: sulfur-based additives, such as sulfurized oils and fats, olefin polysulfides, olefin sulfides, dibenzyl sulfide, ethyl-3-[[bis(1-methylethoxy)phosphinothioyl]thio]propionate, tris-[(2 or 4)-isoalkylphenol] thiophosphates, 3-(di-isobutoxy-thiophosphorylsulfanyl)-2-methyl-propionic acid, triphenyl phosphorothionate, β-dithiophosphorylated propionic acid, methylenebis(dibutyl dithiocarbamate), O,O-diisopropyl-dithiophosphorylethyl propionate, 2,5-bis(n-nonyldithio)-1,3,4-thiadiazole, 2,5-bis(1,1,3,3-tetramethylbutanethio)-1,3,4-thiadiazole, and 2,5-bis(1,1,3,3-tetramethyldithio)-1,3,4-thiadiazole; phosphorus-based compounds, such as monooctyl phosphate, dioctyl phosphate, trioctyl phosphate, monobutyl phosphate, dibutyl phosphate, tributyl phosphate, monophenyl phosphate, diphenyl phosphate, triphenyl phosphate, tricresyl phosphate, monoisopropylphenyl phosphate, diisopropylphenyl phosphate, triisopropylphenyl phosphate, mono-tert-butylphenyl phosphate, di-tert-butylphenyl phosphate, tri-tert-butylphenyl phosphate, triphenyl thiophosphate, monooctyl phosphite, dioctyl phosphite, trioctyl phosphite, monobutyl phosphite, dibutyl phosphite, tributyl phosphite, monophenyl phosphite, diphenyl phosphite, triphenyl phosphite, monoisopropylphenyl phosphite, diisopropylphenyl phosphite, triisopropylphenyl phosphite, mono-tert-butylphenyl phosphite, di-tert-butylphenyl phosphite, and tri-tert-butylphenyl phosphite; organometallic compounds, such as a zinc dithiophosphate (ZnDTP) represented by the general formula (4), dithiophosphoric acid metal salts (Sb, Mo, and the like), dithiocarbamic acid metal salts (Zn, Sb, and the like), naphthenic acid metal salts, fatty acid metal salts, phosphoric acid metal salts, phosphoric acid ester metal salts, and phosphorous acid ester metal salts; and boron compounds, alkylamine salts of mono- and dihexyl phosphates, phosphoric acid ester amine salts, and mixtures of triphenyl thiophosphoric acid esters and tert-butylphenyl derivatives.

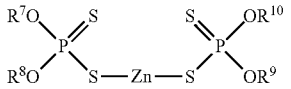

(4)

(In the formula, $R^7$ to $R^{10}$ each independently represent a primary alkyl group or a secondary alkyl group having 1 to 20 carbon atoms or an aryl group.)

In the general formula (4), $R^7$ to $R^{10}$ each independently represent a hydrocarbon group having 1 to 20 carbon atoms, and examples of such group include: primary alkyl groups, such as a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, and an icosyl group; secondary alkyl groups, such as a secondary propyl group, secondary butyl groups, secondary pentyl groups, secondary hexyl groups, secondary heptyl groups, secondary octyl groups, secondary nonyl groups, secondary decyl groups, secondary undecyl groups, secondary dodecyl groups, secondary tridecyl groups, secondary tetradecyl groups, secondary pentadecyl groups, secondary hexadecyl groups, secondary heptadecyl groups, secondary octadecyl groups, secondary nonadecyl groups, and secondary icosyl groups; tertiary alkyl groups, such as a tertiary butyl group, tertiary pentyl groups, tertiary hexyl groups, tertiary heptyl groups, tertiary octyl groups, tertiary nonyl groups, tertiary decyl groups, tertiary undecyl groups, tertiary dodecyl groups, tertiary tridecyl groups, tertiary tetradecyl groups, tertiary pentadecyl groups, tertiary hexadecyl groups, tertiary heptadecyl groups, tertiary octadecyl groups, tertiary nonadecyl groups, and tertiary icosyl groups; branched alkyl groups, such as branched butyl groups (e.g., an isobutyl group), branched pentyl groups (e.g., an isopentyl group), branched hexyl groups (isohexyl group), branched heptyl groups (an isoheptyl group), branched octyl groups (e.g., an isooctyl group and a 2-ethylhexyl group), branched nonyl groups (e.g., an isononyl group), branched decyl groups (e.g., an isodecyl group), branched undecyl groups (e.g., an isoundecyl group), branched dodecyl groups (e.g., an isododecyl group), branched tridecyl groups (e.g., an isotridecyl group), branched tetradecyl groups (isotetradecyl group), branched pentadecyl groups (e.g., an isopentadecyl group), branched hexadecyl groups (an isohexadecyl group), branched heptadecyl groups (e.g., an isoheptadecyl group), branched octadecyl groups (e.g., an isooctadecyl group), branched nonadecyl groups (e.g., an isononadecyl group), and branched icosyl groups (e.g., an isoicosyl group); and aryl groups, such as a phenyl group, a toluyl group, a xylyl group, a cumenyl group, a mesityl group, a benzyl group, a phenethyl group, a styryl group, a cinnamyl group, a benzhydryl group, a trityl group, an ethylphenyl group, a propylphenyl group, a butylphenyl group, a pentylphenyl group, a hexylphenyl group, a heptylphenyl group, an octylphenyl group, a nonylphenyl group, a decylphenyl group, an undecylphenyl group, a dodecylphenyl group, a styrenated phenyl group, a p-cumylphenyl group, a phenylphenyl group, and a benzylphenyl group. The blending amount of such abrasion-preventing agents is preferably from 0.01 mass % to 3 mass %, more preferably from 0.05 mass % to 2 mass % with respect to the base oil.

Examples of the antioxidants include: phenol-based antioxidants, such as 2,6-di-tert-butylphenol (tert-butyl is hereinafter abbreviated as t-butyl), 2,6-di-t-butyl-4-methylphenol, 2,6-di-t-butyl-4-ethylphenol, 2,4-dimethyl-6-t-butylphenol, 4,4'-methylenebis(2,6-di-t-butylphenol), 4,4'-bis(2,6-di-t-butylphenol), 4,4'-bis(2-methyl-6-t-butylphenol), 2,2'-methylenebis(4-methyl-6-t-butylphenol), 2,2'-methylenebis(4-ethyl-6-t-butylphenol), 4,4'-butylidenebis(3-methyl-6-t-butylphenol), 4,4'-isopropylidenebis(2,6-di-t-butylphenol), 2,2'-methylenebis(4-methyl-6-cyclohexylphenol), 2,2'-methylenebis(4-methyl-6-nonylphenol), 2,2'-isobutylidenebis(4,6-dimethylphenol), 2,6-bis(2'-hydroxy-3'-t-butyl-5'-methylbenzyl)-4-methylphenol, 3-t-butyl-4-hydroxyanisole, 2-t-butyl-4-hydroxyanisole, stearyl 3-(4-hydroxy-3,5-di-t-butylphenyl)propionate, oleyl 3-(4-hydroxy-3,5-di-t-butylphenyl)propionate, dodecyl 3-(4-hydroxy-3,5-di-t-butylphenyl)propionate, decyl 3-(4-hydroxy-3,5-di-t-butylphenyl)propionate, octyl 3-(4-hydroxy-3,5-di-t-butylphenyl)propionate, tetrakis{3-(4-hydroxy-3,5-di-t-butylphenyl)propionyloxymethyl} methane, 3-(4-hydroxy-3,5-di-t-butylphenyl)propionic acid glycerin monoester, an ester of 3-(4-hydroxy-3,5-di-t-butylphenyl)propionic acid and glycerin monooleyl ether, 3-(4-hydroxy-3,5-di-t-butylphenyl) propionic acid butylene glycol diester, 3-(4-hydroxy-3,5-di-t-butylphenyl)propionic acid thiodiglycol diester, 4,4'-thiobis(3-methyl-6-t-butylphenol), 4,4'-thiobis(2-methyl-6-t-butylphenol), 2,2'-thiobis(4-methyl-6-t-butylphenol), 4,6-bis(octylthiomethyl)-o-cresol, 4,6-bis(dodecylthiomethyl)-o-cresol, 2,6-di-t-butyl-4-(N,N'-dimethylaminomethylphenol), bis(3,5-di-t-butyl-4-hydroxybenzyl)sulfide, tris{(3,5-di-t-butyl-4-hydroxyphenyl)propionyl-oxyethyl}isocya nurate, tris(3,5-di-t-butyl-4-hydroxyphenyl)isocyanurate, 1,3,5-tris(3,5-di-t-butyl-4-hydroxybenzyl)isocyanurate, bis{2-methyl-4-(3-n-alkylthiopropionyloxy)-5-t-butylphenyl}sulfide, 1,3,5-tris(4-t-butyl-3-hydroxy-2,6-dimethylbenzyl)isocyanurate, tetraphthaloyl-di(2,6-dimethyl-4-t-butyl-3-hydroxybenzylsulfide), 6-(4-hydroxy-3,5-di-t-butylanilino)-2,4-bis(octylthio)-1,3,5-triazine, 2,2'-thio-diethylenebis[3-(3,5-di-t-butyl-4-hydroxyphenyl)propionate], tridecyl-3-(3,5-di-t-butyl-4-hydroxyphenyl)propionate, pentaerythrityl-tetrakis[3-(3,5-di-t-butyl-4-hydroxyphenyl)propionate], octadecyl-3-(3,5-di-t-butyl-4-hydroxyphenyl)propionate, octyl-3-(3,5-di-t-butyl-4-hydroxyphenyl)propionate, heptyl-3-(3,5-di-t-butyl-4-hydroxyphenyl)propionate, octyl-3-(3-methyl-5-t-butyl-4-hydroxyphenyl)propionate, nonyl-3-(3-methyl-5-t-butyl-4-hydroxyphenyl)propionate, hexamethylenebis[3-(3,5-di-t-butyl-4-hydroxyphenyl)propionate], C7-C9 side chain alkyl esters of [3,5-bis(1,1-dimethyl-ethyl)-4-hydroxy]benzenepropionic acid, 3,5-di-t-butyl-4-hydroxybenzyl-phosphoric acid diester, bis(3-methyl-4-hydroxy-5-t-butylbenzyl)sulfide, 1,1,3-tris(2-methyl-4-hydroxy-5-t-butylphenyl)butane, 1,1-bis(2-methyl-4-hydroxy-5-t-butylphenyl)butane, 1,3,5-trimethyl-2,4,6-tris(3,5-di-t-butyl-4-hydroxybenzyl)benz ene, 2,4,6-tris(3,5-di-t-butyl-4-hydroxybenzyl)mesitylene, 3,5-di-t-butyl-4-hydroxybenzylalkyl esters, and bis{3,3'-bis-(4'-hydroxy-3'-t-butylphenyl)butyric acid}glycol ester; naphthylamine-based antioxidants, such as 1-naphthylamine, N-phenyl-1-naphthylamine, N-phenyl-1,1,3,3-tetramethylbutylnaphthalene-1-amine, an N-alkylphenyl-1-naphthylamine, p-octylphenyl-1-naphthylamine, p-nonylphenyl-1-naphthylamine, p-dodecylphenyl-1-naphthylamine, and phenyl-2-naphthylamine; phenylenediamine-based antioxidants, such as N,N'-diisopropyl-p-phenylenediamine, N,N'-diisobutyl-p-phenylenediamine, N,N'-diphenyl-p-phenylenediamine, N,N'-di-β-naphthyl-p-phenylenediamine, N-phenyl-N'-isopropyl-p-phenylenediamine, N-cyclohexyl-N'-phenyl-p-phenylenediamine, N-1,3-dimethylbutyl-N'-phenyl-p-phenylenediamine, dioctyl-p-phenylenediamine, phenylhexyl-p-phenylenediamine, and phenyloctyl-p-phenylenediamine; diphenylamine-based antioxidants, such as dipyridylamine, diphenylamine, a dialkylphenylamine, bis(4-n-butylphenyl)amine, bis(4-t-butylphenyl)amine, bis(4-n-pentylphenyl)amine, bis(4-t-pentylphenyl)amine, bis(4-n-octylphenyl)amine, bis(4-(2-ethylhexyl)phenyl)amine, bis(4-nonylphenyl)amine, bis(4-decylphenyl)amine, bis(4-dodecylphenyl)amine, bis(4-styrylphenyl)amine, bis(4-methoxyphenyl)amine, 4,4'-bis(α,α-dimethylbenzoyl) diphenylamine, 4-isopropoxydiphenylamine, dipyridylamine, and a reaction product of N-phenylbenzenamine and 2,2,4-trimethylpentene; and phenothiazine-based antioxidants, such as phenothiazine, N-methylphenothiazine, N-ethylphenothiazine, 3,7-dioctylphenothiazine, phenothiazinecarboxylic acid esters, and phenoselenazine. The blending amount of such antioxidants is preferably from 0.01 mass % to 5 mass %, more preferably from 0.05 mass % to 4 mass % with respect to the total amount of the lubricating oil composition.

Examples of the viscosity index improvers include poly (C1 to 18)alkylmethacrylates, (C1 to 18)alkylacrylate/(C1 to 18)alkylmethacrylate copolymers, dimethylaminoethyl methacrylate/(C1 to 18)alkylmethacrylate copolymers, ethylene/(C1 to 18)alkylmethacrylate copolymers, polyisobutylenes, polyalkylstyrenes, ethylene/propylene copolymers, styrene/maleic acid ester copolymers, hydrogenated styrene/isoprene copolymers, olefin copolymers (OCP), and star polymers. Alternatively, dispersion-type or multifunctional viscosity index improvers to which dispersing performance has been imparted may be used. The weight-average molecular weight of the viscosity index improver is from about 10,000 to about 1,500,000, preferably from about 20,000 to about 500,000. The blending amount of such viscosity index improvers is preferably from 0.1 mass % to 20 mass %, more preferably from 0.3 mass % to 15 mass % with respect to the base oil.

Examples of the pour-point depressants include polyalkyl methacrylates, polyalkyl acrylates, polyalkylstyrenes, ethylene-vinyl acetate copolymers, and polyvinyl acetates. The weight-average molecular weight of the pour-point depressant is from about 1,000 to about 100,000, preferably from about 5,000 to about 50,000. The blending amount of such pour-point depressants is preferably from 0.005 mass % to 3 mass %, more preferably from 0.01 mass % to 2 mass % with respect to the base oil.

Examples of the rust inhibitors include sodium nitrite, oxidized paraffin wax calcium salts, oxidized paraffin wax magnesium salts, tallow fatty acid alkali metal salts, tallow fatty acid alkaline earth metal salts, alkenylsuccinic acids, alkenylsuccinic acid half esters (the molecular weight of the alkenyl group is from about 100 to about 300), sorbitan monoesters, nonylphenol ethoxylate, and lanolin fatty acid calcium salts. The blending amount of such rust inhibitors is preferably from 0.01 mass % to 3 mass %, more preferably from 0.02 mass % to 2 mass % with respect to the base oil.

Examples of the corrosion inhibitors or the metal deactivators include: triazole, tolyltriazole, benzotriazole, benzimidazole, benzothiazole, benzothiadiazole, or derivatives of these compounds, such as 2-hydroxy-N-(1H-1,2,4-triazol-3-yl)benzamide, N,N-bis(2-ethylhexyl)-[(1,2,4-triazol-1-yl)methyl]amine, N,N-bis(2-ethylhexyl)-[(1,2,4-triazol-1-yl)methyl]amine, and 2,2'-[[(4 or 5 or 1)-(2-ethylhexyl)-methyl-1H-benzotriazole-1-methyl]imino]bisethanol; and bis(poly-2-carboxyethyl)phosphinic acid, hydroxyphosphonoacetic acid, tetraalkylthiuram disulfides, N'1,N'12-bis(2-hydroxybenzoyl)dodecane dihydrazide, 3-(3,5-di-t-butyl-hydroxyphenyl)-N'-(3-(3,5-di-tert-butyl-hydr oxyphenyl) propanoyl)propane hydrazide, an esterification product of tetrapropenylsuccinic acid and 1,2-propanediol, disodium sebacate, (4-nonylphenoxy)acetic acid, alkylamine salts of mono- and dihexyl phosphates, a sodium salt of tolyltriazole, and (Z)—N-methyl N-(1-oxo-9-octadecenyl)glycine. The blending amount of such corrosion inhibitors is preferably from 0.01 mass % to 3 mass %, more preferably from 0.02 mass % to 2 mass % with respect to the base oil.

Examples of the antifoaming agents include polydimethylsilicones, dimethylsilicone oil, trifluoropropylmethylsilicones, colloidal silicas, polyalkylacrylates, polyalkylmethacrylates, alcohol ethoxylates/propoxylates, fatty acid ethoxylates/propoxylates, and sorbitan partial fatty acid esters. The blending amount of such antifoaming agents is preferably from 0.001 mass % to 0.1 mass %, more preferably from 0.001 mass % to 0.01 mass % with respect to the base oil.

The lubricating oil composition of the present invention can be used in, for example, vehicular lubricating oils (such as gasoline engine oils and diesel engine oils for automobiles or motorbikes) and industrial lubricating oils (such as gear oils, turbine oils, oil film bearing oils, refrigerant lubricating oils, vacuum pump oils, lubricating oils for compression machines, and general-purpose lubricating oils). Of those, the lubricating oil composition of the present invention is preferably used in vehicular lubricating oils because the effects of the present invention can be easily obtained.

EXAMPLES

The present invention is hereinafter specifically described by way of Examples, but the present invention is by no means limited by these Examples.

<Organic Molybdenum Compounds Used in Examples and Comparative Examples>

The following organic molybdenum compounds I and II were prepared by the method described in JP 10-17586 A.

Organic molybdenum compound I (molybdenum dithiocarbamate (A)-1)

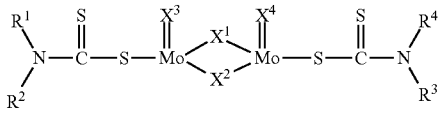

(1)

($R^1$, $R^2$, $R^3$, and $R^4$ represent a combination of $C_8H_{17}$ and $C_{13}H_{27}$ ($C_8H_{17}$:$C_{13}H_{27}$=1:1 (molar ratio)), $X^1$ and $X^2$ each represent a sulfur atom, and $X^3$ and $X^4$ each represent an oxygen atom.)

Organic Molybdenum Compound II (Molybdenum Dithiocarbamate (A)-2)

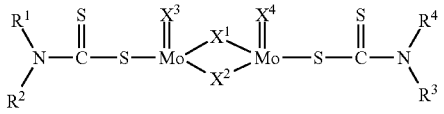

(1)

($R^1$, $R^2$, $R^3$, and $R^4$ each represent $C_8H_{17}$, $X^1$ and $X^2$ each represent a sulfur atom, and $X^3$ and $X^4$ each represent an oxygen atom)

Organic Molybdenum Compound III (Molybdenum Dithiophosphate)

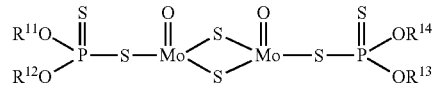

(5)

($R^{11}$, $R^{12}$, $R^{13}$, and $R^{14}$ each represent $C_8H_{17}$)

Organic Molybdenum Compound IV (Molybdenum Amine)

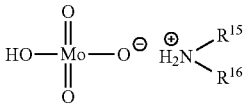

(6)

($R^{15}$ and $R^{16}$ each represent $C_{13}H_{27}$)

<Copolymers Used in Examples and Comparative Examples>

Monomer raw materials used in producing copolymers used in Examples and Comparative Examples are as follows.

Monomer Raw Material for Forming Unit (a)

(a)-1: n-Dodecyl acrylate ($R^5$ in the general formula (2) represents an n-dodecyl group)

(a)-2: n-Octadecyl acrylate ($R^5$ in the general formula (2) represents an n-octadecyl group)

(a)-3: n-Butyl acrylate ($R^5$ in the general formula (2) represents an n-butyl group)

(a)-4: 2-Ethylhexylacrylate ($R^5$ in the general formula (2) represents an 2-ethylhexyl group)

Monomer Raw Material for Forming Unit (b)

(b)-1: 2-Hydroxyethyl acrylate ($R^6$ in the general formula (3) represents an ethylene group)

Other Monomer Raw Material (a')-1: n-Dodecyl methacrylate (b')-1: 2-Hydroxyethyl methacrylate Copolymers to be used in Examples and Comparative Examples, produced using the above-mentioned monomer raw materials, are shown in Table 1 below. It should be noted that the copolymers (B)-1 to (b)-8 are copolymers (B) that can be used in the lubricant composition of the present invention, and the copolymers (B')-1 to (B')-4 are copolymers (B') to be used in Comparative Examples. In addition, GPC measurement for the copolymers (B)-1 to (B)-8 and (B')-1 to (B')-4 were carried out under the following conditions.

GPC apparatus: semi-micro HPLC 7400 (manufactured by GL Sciences Inc.)

Column: four columns of GPCKF-401HQ, GPCKF-402.5, GPCLF-404, and GPCLF-404 used in tandem (each of which is manufactured by Showa Denko K.K.)

Detector: GL-7454 (manufactured by GL Sciences Inc.)

Flow rate: 0.3 ml/min

Sample concentration: 0.2 mass % (THF solution)

Sample volume: 5 μl

Column temperature: 40° C.

Standard sample: polystyrene

TABLE 1

| Copolymer | Type of monomer: Monomer raw material for forming unit (a) | | Monomer raw material for forming unit (b) | Other monomer raw material | | Molar ratio of constitutional units of copolymer (molar ratio of raw material monomers) | Molecular weight |
|---|---|---|---|---|---|---|---|
| (B)-1 | (a)-1 | | (b)-1 | | | (a)-1:(b)-1 = 60:40 | 61,000 |
| (B)-2 | (a)-1 | | (b)-1 | | | (a)-1:(b)-1 = 60:40 | 13,000 |
| (B)-3 | (a)-1 | | (b)-1 | | | (a)-1:(b)-1 = 60:40 | 110,000 |
| (B)-4 | (a)-1 | | (b)-1 | | | (a)-1:(b)-1 = 70:30 | 50,000 |
| (B)-5 | (a)-1 | | (b)-1 | | | (a)-1:(b)-1 = 80:20 | 100,000 |
| (B)-6 | (a)-2 | | (b)-1 | | | (a)-2:(b)-1 = 70:30 | 50,000 |
| (B)-7 | (a)-2 | (a)-3 | (b)-1 | | | (a)-2:(a)-3:(b)-1 = 32:32:36 | 75,000 |
| (B)-8 | (a)-2 | (a)-4 | (b)-1 | | | (a)-2:(a)-4:(b)-1 = 35:35:30 | 50,000 |
| (B')-1 | (a)-1 | | (b)-1 | | | (a)-1:(b)-1 = 40:60 | 63,000 |
| (B')-2 | (a)-1 | | (b)-1 | | | (a)-1:(b)-1 = 95:5 | 50,000 |
| (B')-3 | (a)-1 | | (b)-1 | | | (a)-1:(b)-1 = 60:40 | 230,000 |
| (B')-4 | | | | (a')-1 | (b')-1 | (a')-1:(b')-1 = 60:40 | 110,000 |

Method of Producing Copolymer (B)-1

269 g (1.12 mol) of (a)-1 used as a monomer for forming a unit (a), 87 g (0.75 mol) of (b)-1 used as a monomer for forming a unit (b), and 178 g of methanol and 178 g of dioxane used as solvents were loaded into a four-necked flask having a volume of 1,000 ml mounted with a temperature gauge, a nitrogen-introducing tube, and a stirring machine. The flask was purged with nitrogen, and 3.3 g of 2,2'-azobis(2-methylpropionitrile) was added thereto as an initiator. After that, the temperature was gradually increased while the mixture was stirred, followed by a reaction for 5 hours at from 85° C. to 95° C. while the mixture was refluxed. Thus, a copolymer (B)-1 was obtained. The copolymer (B)-1 was found to have a composition ratio of the unit (a) represented by the general formula (2) to the unit (b) represented by the general formula (3) of 60/40 (by mole) and a weight-average molecular weight of 61,000 in terms of styrene, which was measured by GPC for determining molecular weight.

Method of Producing Copolymers (B)-2 to (B)-8 and (B')-1 to (B')-4

Copolymers (B)-2 to (B)-8 and (B')-1 to (B')-4 were synthesized using the monomer raw materials according to Table 1 in the same manner as that for the copolymer (B)-1. It should be noted that in production of the copolymers, the amounts of the initiator, the types of the solvents, and the like were appropriately adjusted to prepare copolymers having the compositions and molecular weights shown in Table 1.

Evaluation of Lubrication Characteristic

Preparation of Oils to be Evaluated

To perform a lubrication characteristic evaluation for investigating friction characteristics under a severe condition in which a high contact pressure is applied, lubricant compositions No. 1 to No. 25 containing the organic molybdenum compounds I to IV and the copolymers (B)-1 to (B)-8 and (B')-1 to (B')-4 were prepared and added to a commercially available engine oil to produce lubricating oil compositions No. 1 to 25. Specifically, the respective lubricant compositions No. 1 to 25 were dissolved completely in a commercially available engine oil SN GF-5 5W-30 (manufactured by Toyota Motor Corporation) under heat at ratios shown in Tables 2 and 3, and the samples were returned to room temperature to prepare the lubricating oil compositions No. 1 to 25. In Table 2, the blending amounts of the respective components in the lubricating oil compositions No. 1 to 13 of the present invention (Examples 1 to 13) are shown, and in Table 3, the blending amounts of the respective components in the lubricating oil compositions No. 14 to 25 prepared as comparative products (Comparative Examples 1 to 12) are shown. In addition, as a control, only the commercially available engine oil SN GF-5 5W-30 (manufactured by Toyota Motor Corporation) was subjected to the evaluation (Comparative Example 13) at the same time.

TABLE 2

| | Example 1 Lubricating oil composition No. 1 | Example 2 Lubricating oil composition No. 2 | Example 3 Lubricating oil composition No. 3 | Example 4 Lubricating oil composition No. 4 | Example 5 Lubricating oil composition No. 5 | Example 6 Lubricating oil composition No. 6 | Example 7 Lubricating oil composition No. 7 |
|---|---|---|---|---|---|---|---|
| Organic molybdenum compound I | 700 ppm | 700 ppm | 700 ppm | 700 ppm | 700 ppm | 700 ppm | 700 ppm |
| Organic molybdenum compound II | | | | | | | |
| Organic molybdenum compound III | | | | | | | |
| Organic molybdenum compound IV | | | | | | | |
| Copolymer (B)-1 | 1 mass % | | | | | | |
| Copolymer (B)-2 | | 1 mass % | | | | | |
| Copolymer (B)-3 | | | 1 mass % | | | | |
| Copolymer (B)-4 | | | | 1 mass % | | | |
| Copolymer (B)-5 | | | | | 1 mass % | | |
| Copolymer (B)-6 | | | | | | 1 mass % | |
| Copolymer (B)-7 | | | | | | | 1 mass % |
| Copolymer (B)-8 | | | | | | | |
| Engine oil | | | | SN GF-5 5W-30 | | | |

| | Example 8 Lubricating oil composition No. 8 | Example 9 Lubricating oil composition No. 9 | Example 10 Lubricating oil composition No. 10 | Example 11 Lubricating oil composition No. 11 | Example 12 Lubricating oil composition No. 12 | Example 13 Lubricating oil composition No. 13 |
|---|---|---|---|---|---|---|
| Organic molybdenum compound I | 700 ppm | | 700 ppm | 350 ppm | 700 ppm | 1,400 ppm |
| Organic molybdenum compound II | | 700 ppm | | | | |
| Organic molybdenum compound III | | | | | | |
| Organic molybdenum compound IV | | | | | | |
| Copolymer (B)-1 | | 1 mass % | | | | |
| Copolymer (B)-2 | | | | | | |
| Copolymer (B)-3 | | | | | | |
| Copolymer (B)-4 | | | 0.5 mass % | 1 mass % | 2 mass % | 2 mass % |
| Copolymer (B)-5 | | | | | | |
| Copolymer (B)-6 | | | | | | |
| Copolymer (B)-7 | | | | | | |
| Copolymer (B)-8 | 1 mass % | | | | | |
| Engine oil | | | SN GF-5 5W-30 | | | |

TABLE 3

| | Comparative Example 1 Lubricating oil composition No. 14 | Comparative Example 2 Lubricating oil composition No. 15 | Comparative Example 3 Lubricating oil composition No. 16 | Comparative Example 4 Lubricating oil composition No. 17 | Comparative Example 5 Lubricating oil composition No. 18 | Comparative Example 6 Lubricating oil composition No. 19 | Comparative Example 7 Lubricating oil composition No. 20 |
|---|---|---|---|---|---|---|---|
| Organic molybdenum compound I | | | | | 700 ppm | | |
| Organic molybdenum compound II | | | | | | 700 ppm | |
| Organic molybdenum compound III | 700 ppm | | | | | | 700 ppm |

TABLE 3-continued

| | | | | | | |
|---|---|---|---|---|---|---|
| Organic molybdenum compound IV | | 700 ppm | | | | |
| Copolymer (B)-1 | 1 mass % | 1 mass % | 1 mass % | | | |
| Copolymer (B')-1 | | | | | | |
| Copolymer (B')-2 | | | | | | |
| Copolymer (B')-3 | | | | | | |
| Copolymer (B')-4 | | | | 1 mass % | | |
| Engine oil | | | SN GF-5 5W-30 | | | |

| | Comparative Example 8 Lubricating oil composition No. 21 | Comparative Example 9 Lubricating oil composition No. 22 | Comparative Example 10 Lubricating oil composition No. 23 | Comparative Example 11 Lubricating oil composition No. 24 | Comparative Example 12 Lubricating oil composition No. 25 | Comparative Example 13 Only engine oil |
|---|---|---|---|---|---|---|
| Organic molybdenum compound I | | 700 ppm | 700 ppm | 700 ppm | 700 ppm | |
| Organic molybdenum compound II | | | | | | |
| Organic molybdenum compound III | | | | | | |
| Organic molybdenum compound IV | 700 ppm | | | | | |
| Copolymer (B)-1 | | | | | | |
| Copolymer (B')-1 | | 1 mass % | | | | |
| Copolymer (B')-2 | | | 1 mass % | | | |
| Copolymer (B')-3 | | | | 1 mass % | | |
| Copolymer (B')-4 | | | | | 1 mass % | |
| Engine oil | | | SN GF-5 5W-30 | | | |

Evaluation Method

Coefficients of friction in a ball-on-plate reciprocating sliding of the samples of Examples 1 to 13 and Comparative Examples to 13 shown in Tables 2 and 3 were compared using a load fluctuation-type friction and wear tester (HEIDON TYPE: HHS2000; manufactured by Shinto Scientific Co., Ltd.). The test was carried out under the following conditions, and friction-reducing effects were compared based on average values of the coefficients of friction of 100 strokes before completion of the test. In the results, a smaller coefficient of friction means a higher friction-reducing effect. The results are shown in Tables 4 and 5.

Test Conditions

Load: 1.96 N

Maximum contact pressure: 0.5 GPa

Sliding speed: 10 mm/sec

Amplitude: 10 mm

Test distance: 600 strokes

Test temperature: 80° C.

Test material: ball, φ12.7 mm (½ inch), SUJ2

Test material plate: SUJ2

TABLE 4

| | Example 1 Lubricating oil composition No. 1 | Example 2 Lubricating oil composition No. 2 | Example 3 Lubricating oil composition No. 3 | Example 4 Lubricating oil composition No. 4 | Example 5 Lubricating oil composition No. 5 | Example 6 Lubricating oil composition No. 6 | Example 7 Lubricating oil composition No. 7 |
|---|---|---|---|---|---|---|---|
| Coefficient of friction | 0.086 | 0.094 | 0.066 | 0.046 | 0.085 | 0.064 | 0.079 |

| | Example 8 Lubricating oil composition No. 8 | Example 9 Lubricating oil composition No. 9 | Example 10 Lubricating oil composition No. 10 | Example 11 Lubricating oil composition No. 11 | Example 12 Lubricating oil composition No. 12 | Example 13 Lubricating oil composition No. 13 |
|---|---|---|---|---|---|---|
| Coefficient of friction | 0.077 | 0.091 | 0.042 | 0.092 | 0.043 | 0.048 |

TABLE 5

| | Comparative Example 1 Lubricating oil composition No. 14 | Comparative Example 2 Lubricating oil composition No. 15 | Comparative Example 3 Lubricating oil composition No. 16 | Comparative Example 4 Lubricating oil composition No. 17 | Comparative Example 5 Lubricating oil composition No. 18 | Comparative Example 6 Lubricating oil composition No. 19 | Comparative Example 7 Lubricating oil composition No. 20 |
|---|---|---|---|---|---|---|---|
| Coefficient of friction | 0.116 | 0.127 | 0.140 | 0.139 | 0.133 | 0.131 | 0.138 |

| | Comparative Example 8 Lubricating oil composition No. 21 | Comparative Example 9 Lubricating oil composition No. 22 | Comparative Example 10 Lubricating oil composition No. 23 | Comparative Example 11 Lubricating oil composition No. 24 | Comparative Example 12 Lubricating oil composition No. 25 | Comparative Example 13 Only engine oil |
|---|---|---|---|---|---|---|
| Coefficient of friction | 0.138 | — | 0.110 | — | 0.127 | 0.136 |

As a result, the lubricating oil compositions containing the molybdenum dithiocarbamate (A)-1 or (A)-2 represented by the general formula (1) and any of the copolymers (B)-1 to (B)-8 were found to exhibit high friction-reducing effects under a severe condition in which a high contact pressure was applied. It should be noted that, in this experiment, the copolymers (B')-1 and (B')-3 in the lubricating oil composition No. 22 (Comparative Example 9) and the lubricating oil composition No. 24 (Comparative Example 11) were not dissolved in the engine oil and formed precipitates, and hence the compositions could not be evaluated.

INDUSTRIAL APPLICABILITY

The lubricant composition of the present invention, including the molybdenum dithiocarbamate and the acrylic polymer in combination, is an additive for a lubricating oil that exhibits a high friction-reducing effect even under severe conditions in which high contact pressure is applied. The composition can be used as a vehicular lubricating oil as well as an industrial lubricating oil and can be expected to be used in various applications in the future, and hence the present invention is very useful.

The invention claimed is:

1. A lubricating oil composition, comprising:

a molybdenum dithiocarbamate (A) of the following formula (1);

a copolymer (B) that comprises, as essential constitutional units, a unit (a) of the following formula (2) and a unit (b) of the following formula (3), has a weight-average molecular weight of from 5,000 to 150,000, has a composition ratio of the unit (a) to the unit (b), i.e., (a)/(b), of from 50/50 to 90/10 by mole, and comprises a total of 90 mass % or more of the unit (a) and the unit (b); and a base oil consisting of a mineral base oil, wherein a molybdenum content from the molybdenum dithiocarbamate (A) in the lubricating oil composition is from 300 ppm by mass to 1,500 ppm by mass;

wherein a molybdenum content of the molybdenum dithiocarbamate (A) is from 0.03 part by mass to 0.2 part by mass with respect to 1 part by mass of the copolymer (B); and wherein a concentration of the copolymer (B) in the lubricating composition is from 0.5% by mass to 2.0% by mass:

(1)

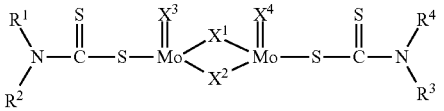

where $R^1$ to $R^4$ each independently represent a hydrocarbon group having 1 to 20 carbon atoms, and $X^1$ to $X^4$ each independently represent a sulfur atom or an oxygen atom;

(2)

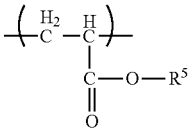

where $R^5$ represents an alkyl group having 4 to 18 carbon atoms; and (3)

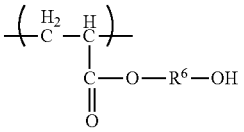

where $R^6$ represents an ethylene group.

2. The lubricating oil composition according to claim 1, wherein the copolymer (B) consists essentially of the unit (a) and the unit (b).

3. The lubricating oil composition according to claim 1, wherein the copolymer (B) has a weight-average molecular weight of from 40,000 to 110,000.

4. The lubricating oil composition according to claim 1, wherein the copolymer (B) has a composition ratio of the unit (a) to the unit (b), i.e., (a)/(b), of from 60/40 to 80/20 by mole.

5. The lubricating oil composition according to claim 1, wherein $R^5$ in the formula (2) in the unit (a) of the copolymer (B) represents a primary alkyl group having 12 to 18 carbon atoms and $R^6$ in the formula (3) in the unit (b) represents an ethylene group.

6. The lubricating oil composition according to claim 1, wherein the molybdenum dithiocarbamate (A) comprises: a compound in which $R^1$ to $R^4$ in the formula (1) represent a combination of $C_8H_{17}$ and $C_{13}H_{27}$, a ratio of $C_8H_{17}$ and $C_{13}H_{27}$ is 1:1 by mole, $X^1$ and $X^2$ each represent a sulfur atom, and $X^3$ and $X^4$ each represent an oxygen atom; or a compound in which $R^1$ to $R^4$ in the formula (1) each represent $C_8H_{17}$, $X^1$ and $X^2$ each represent a sulfur atom, and $X^3$ and $X^4$ each represent an oxygen atom.

7. The lubricating oil composition according to claim 1, further comprising, with respect to the lubricating oil composition, a total of from 0.01 mass % to 40 mass % of one or more agents selected from the group consisting of metal-based cleaning agents, ashless dispersants, abrasion-preventing agents, antioxidants, viscosity index improvers, pour-point depressants, rust inhibitors, corrosion inhibitors, metal deactivators, and antifoaming agents.

8. A method of enhancing a friction-reducing effect of a molybdenum dithiocarbamate (A) of the following formula (1) in a lubricating oil composition, the method comprising using the molybdenum dithiocarbamate (A) in combination with a copolymer (B) and a base oil consisting of a mineral base oil, wherein the copolymer (B) comprises, as essential constitutional units, a unit (a) of the following formula (2) and a unit (b) of the following formula (3), has a weight-average molecular weight of from 5,000 to 150,000, has a composition ratio of the unit (a) to the unit (b), i.e., (a)/(b), of from 50/50 to 90/10 by mole, and comprises a total of 90 mass % or more of the unit (a) and the unit (b); and wherein a molybdenum content from the molybdenum dithiocarbamate (A) in the lubricating oil composition is from 300 ppm by mass to 1,500 ppm by mass;

wherein a molybdenum content of the molybdenum dithiocarbamate (A) is from 0.03 part by mass to 0.2 part by mass with respect to 1 part by mass of the copolymer (B); and wherein a concentration of the copolymer (B) in the lubricating composition is from 0.5% by mass to 2.0% by mass:

(1)

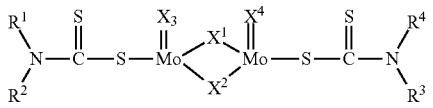

where $R^1$ to $R^4$ each independently represent a hydrocarbon group having 1 to 20 carbon atoms, and $X^1$ to $X^4$ each independently represent a sulfur atom or an oxygen atom;

(2)

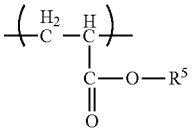

where $R^5$ represents an alkyl group having 4 to 18 carbon atoms; and (3)

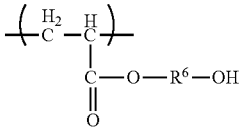

where $R^6$ represents an ethylene group.

* * * * *